US005675934A

United States Patent [19]

Park

[11] Patent Number: 5,675,934

[45] Date of Patent: Oct. 14, 1997

[54] DEVICE CAPABLE OF OPENING/CLOSING A DOOR AT EITHER SIDE THEREOF

[75] Inventor: Byung Ki Park, Sungnam, Rep. of Korea

[73] Assignee: Hong Il Lee, Seoul, Rep. of Korea; a part interest

[21] Appl. No.: 591,655

[22] PCT Filed: Jun. 16, 1995

[86] PCT No.: PCT/KR95/00077

§ 371 Date: Feb. 12, 1996

§ 102(e) Date: Feb. 12, 1996

[87] PCT Pub. No.: WO95/35426

PCT Pub. Date: Dec. 28, 1995

[30] Foreign Application Priority Data

Jun. 16, 1994 [KR] Rep. of Korea ..... 1994/13588

[51] Int. Cl.[6] ..... E05D 15/50

[52] U.S. Cl. ..... 49/193; 16/232; 16/DIG. 23

[58] Field of Search ..... 49/193, 382; 312/405, 312/326; 16/232, 233, 231, 366, 380, DIG. 23

[56] References Cited

U.S. PATENT DOCUMENTS 3,889,419 6/1975 Maleck .
4,495,673 1/1985 Khan .
4,503,582 3/1985 Gurubatham .
4,503,583 3/1985 Frohbieter .
4,811,518 3/1989 Ladisa ..... 49/193
5,064,255 11/1991 Inui et al. .

FOREIGN PATENT DOCUMENTS 0 501 021 A1 2/1992 European Pat. Off. .
6058034 6/1994 Japan ..... 49/382

*Primary Examiner*—Kenneth J. Dorner
*Assistant Examiner*—Curtis Cohen
*Attorney, Agent, or Firm*—Christensen O'Connor Johnson & Kindness PLLC

[57] ABSTRACT

A device capable of opening/closing a door selectively closing an access opening of a main body at either side thereof comprises: at least a pair of hinge pins installed at the main body; a fixing member fixed on the door having pin guide grooves for the hinge pins; a pair of pin holders having a pin holding recess for accommodating radially said hinge pin and a pinion-toothed portion; a pair of rack-toothed portions provided on said fixing member to engage with said pinion-toothed portions of said pin holders, so that said pin holders rotate on their own axis when they are moving along said pin guide grooves; a pair of transverse sliders moving together with said pin holders; and a pair of latch members. The side surface of said transverse slider and corresponding outer end of said latch member has a contour relation that the transverse movement of said transverse slider causes the longitudinal movement of said latch member.

9 Claims, 12 Drawing Sheets

DEVICE CAPABLE OF OPENING/CLOSING A DOOR AT EITHER SIDE THEREOF

This is a United States national application corresponding to copending international application PCT/KR95/00077, filed Jun. 16, 1995, which designates the United States, the benefit of the filing date of which is hereby claimed under 35 U.S.C. §120.

TECHNICAL FIELD

The present invention relates to an opening/closing device for use in a door, and more particularly to an opening/closing device of a door by which the door can be opened/closed optionally at either desired side thereof.

BACKGROUND ART

A door is a useful structure in a human life which is necessarily installed in buildings, furniture, electric home appliances such as a refrigerator or a microwave oven, automobiles and so forth. The door generally has hinges disposed only at one of the right and left sides and a grip disposed at the other side of the door, and thereby is designed to be opened or closed at one side of the door.

Accordingly, it may be inconvenient for a user to use the door according as he is left-handed or right-handed, because the opening direction of the door is limited to only the predetermined direction as described above. There is a further disadvantage, by which the effective utilization of space is largely limited, that a user must always select a place, in which an appliance having a door as described above is placed, in consideration of the opening direction of the door.

U.S. Pat. No. 5,064,555 issued to Yoshio Inui et al. discloses an opening/closing device of a door as a proposal to avoid such inconveniences as described above. The device, which enables a door to be opened/closed at either side thereof and is particularly suitable to be used for a refrigerator, has hinge pins 102A, 102B disposed at the left and right end portions of one of a door and a body to which the door is assembled, a fixing plate 104B provided at the other of the door and the body and having grooves 107A, 107B in which the hinge pins 102A, 102B can be detachably engaged from the opening side of the door, and latch plates 105A, 105B rotatably disposed at the left and right ends of the fixing plate 104B and having latch grooves 108A, 108B in which the hinge pins 102A, 102B can be engaged, as shown in FIGS. 14 and 15. Links 106A, 106B are respectively mounted on each of the latch plates 105A, 105B, one end of each link being pivotally fixed at the end of each of shafts 113A, 111B protruding from the fixing plate 104B, and the other ends of the links 106A, 106B being connected with each other via a coupling link 106C. The latch plates 105A, 105B have lock pins 115A, 115B, and the links 106A, 106B on the latch plates 105A, 105B have lock holes 114A, 114B having slide guide sections 114A1, 114B1 and stopper sections 114A2, 114B extending not in alignment with each other in which the lock pins 115A, 115B are engaged.

In the opening/closing device of a door, when a user pulls out the left side of the door in a closed state as shown in FIG. 24, the hinge pin 102B escapes from the groove 107B and the latch plate 105B rotates clockwise, and thereby the door is opened as shown in FIG. 25. At this moment, the lock pin 115B of the latch plate 105B moves along the slide guide section 114B of the link 106B, so that the link 106B is slanted to one side and the link 106A is slanted accordingly through the coupling link 106C. Thus, the lock pin 115A of the right latch plate 105A comes into the stopper portion 114A2 of the lock hole 114A so as to prevent the right latch plate 105A from rotating even when a force for separating the hinge pin 102A is applied, and thereby can perform its hinge function safely.

When the left side of the door is being closed from the opened state thereof, the latch plate 105B is rotated and returned to the initial closed state by the hinge pin 102B. Toggle-type springs 110A, 110B are provided so as to ensure the rotating operation of the latch plates 105A, 105B between the opened and closed positions thereof.

Necessary conditions for double-side operation in a opening/closing device for a door are as follow:

1) Hinge pins at each side of the door must be maintained so that the hinge pins can be inserted into a certain object and escaped from it, 2) When the latch member of the side is in the opened state thereof, the latch member of the other side must secure a hinge pin firmly, 3) The latch member having been in the opened state thereof must be maintained in a state for re-accepting the hinge pin.

In the above-described known opening/closing device, latch plates 105A, 105B were adapted or inserting and escaping a hinge pin respectively, and three link members 106A, 106B, 106C, lock pins 115A, 115B, and lock grooves 114A, 114B were used for satisfying said conditions 2) and 3).

Meanwhile, because the disclosed opening/closing device for a door includes relatively many operating members and thus its structure is complicated, the cost of production and the rate of trouble occurrence of the device may be high. Further, because some link are installed transversely to the width direction of the door, there is a certain limitation for reducing the thickness of the device. Therefore, even though the disclosed opening/closing device may be suitable in a relative thick door such as that of a refrigerator, it does not appropriate for a door having a thin thickness. Also, because the coupling link 106C for the cooperation of the left and right links 105B, 106A transmits a force only linearly, the discolsed device can not be adopted in a covered door being inflated forward, backward, or toward in any one direction.

DISCLOSURE OF INVENTION

Accordingly, it is an object of the present invention to provide a device capable of opening/closing a door at either side thereof which can be adopted in a thin thickness door and has a simple construction.

It is another object of the present invention to provide a device capable of opening/closing a door at either side thereof which can be adopted even for a door having various sectional shape.

To achieve the above objects, the present invention provides a device capable of opening/closing a door selectively closing an access opening of a main body at each side thereof comprising: at least a pair of hinge pins installed opposed to each other at the opposite side end regions of one of the door and the main body with which the door is assembled; a fixing member fixed on the other one of the door and the main body, the fixing member having pin guide grooves into/out which each of the hinge pins come in a pivoting direction of the door pivoting at the opposite hinge pin; a pair of pin holders having a pin holding recess for accommodating radially the hinge pin being introduced into the pin guide groove, each of the pin holder being capable of slidingly moving along the pin guide groove and being formed with a pinion-toothed portion on circumferential surface; a pair of rack-toothed portions provided on the fixing member to engage with the pinion-toothed portions of the pin holders, so that the pin holders rotate on their own axis when they are moving along the pin guide grooves; a pair of transverse sliders moving together with the pin holders in the transverse direction of the fixing member; and a pair of latch members supported at the fixing member to move in a longitudinal direction of the fixing member, the latch members having inner ends facing each other with a predetermined gap and outer ends contacting with side surface of respective corresponding transverse slider; wherein the side surface of the transverse slider and corresponding outer end of the latch member has a contour relation that the transverse movement of the transverse slider causes the longitudinal movement of the latch member in a manner that, when the pin holder is positioned at entrance of the pin guide groove, corresponding latch member is moved toward the opposite latch member to contact therewith thereby to obstruct the longitudinal movement of the opposite latch member and then the transverse movement of the opposite transverse slider, when the pin holder is introduced into the pin guide groove, the corresponding latch member moves away from the opposite latch member to allow the longitudinal movement of the opposite latch member and then the transverse movement of the opposite transverse slider.

Preferably, at least one of the side surface of the transverse slider and the outer end of the latch member has two stepped positions and a inclined suface connecting smoothly the positions, a rolling member is interposed between the side surface of the transverse slider and the outer end of the latch member. A compression spring may be provided for urging the transverse slider toward the entrance of the pin guide groove, so that the transverse slider can be matained in a state capable of receiving the hinge pin. To improve the contact between the transverse slider and latch member, a compression spring may be provided in the gap between the latch members.

A mediation means may be interposed between the compression spring and at least one of the latch members. When the mediation means has flexibility in his traveling path to conform to for example a curved path, the present device may be employed in a curved door. Such a mediation means may consist of a plurality of rollable elements.

In a preferred example of the invention, the device may further comprise a lock means for preventing the latch member, which is at the opened side of the door and has been moved toward the opposite latch member, from returning, and for allowing the latch member to be released when the door is closing, thereby to secure hinge function in the opened state of the door.

The lock means may comprise a lock slot formed in each of the latch members including a longitudinal slot portion and transverse slot portion communicated with the longitudinal slot portion, and a lock pin disposed on the fixing member to be movable transversely to the moving direction of the latch member, having an external end portion projecting between the door and the main body and a stopping projection moving in the lock slot, and being urged by a spring toward outside, thereby when one latch member moves toward the opposite latch member, the stopping projection of the lock pin moves along the longitudinal slot portion and then the transverse slot portion of the lock slot to prevent the one latch member from returning, and when the door comes close to the main body, the lock pin retracts into the fixing member against the spring and then the stopping projection moves back along The transverse slot portion and subsequently the longitudinal slot portion to release the latch member.

Alternatively, the lock means may comprise a pawl mounted on the fixing member and a catch portion formed on the latch member to engage with the pawl, the pawl and the catch portion engage with each other when the door is opened to prevent the corresponding latch member from returning, and when the door comes close to the main body, The pawl and the catch portion unengage to release the corresponding latch member.

On the other hand, the device may further comprise a transverse slider lock means for moving cooperatively with the opening and closing movement of the door, the transverse slider lock means prevents the transverse slider from returning by projecting on the rear side of the transverse slider at the opened side of the door and release the transverse slider when the door is closing.

Meanwhile, the hinge pins may be freely rotatable at their axis, for example by supporting with thrust bearing.

DETAILED DESCRIPTION OF THE EMBODIMENTS

Figure 1:
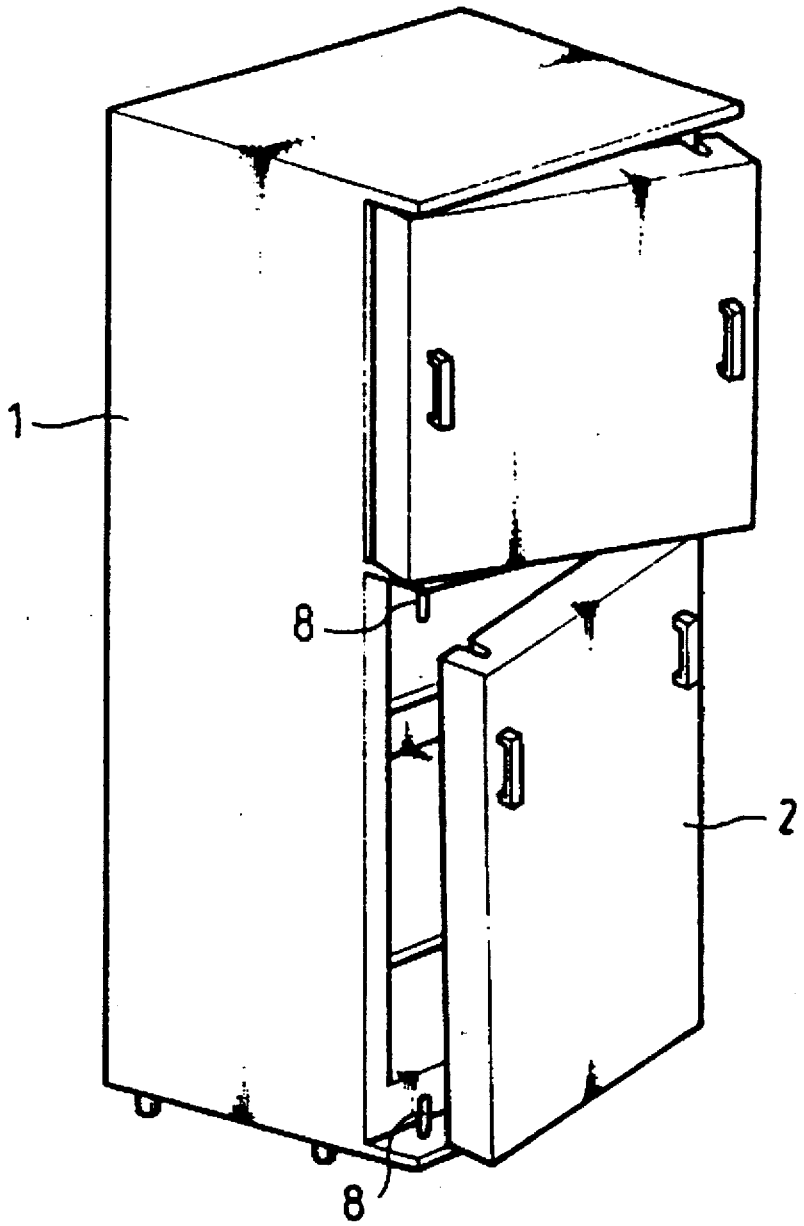
FIG. 1 is a perspective view of a refrigerator including a device capable of opening/closing a door at either side thereof according to the invention.

FIG. 1 is a perspective view of a refrigerator including a device capable of opening/closing a door at either side thereof according to the invention. Referring to FIG. 1, a main body 1 of the refrigerator has upper and lower access openings which are mounted with upper and lower doors 2 respectively. The upper door is opened at the right side thereof and the lower door 2 is opened at the left side thereof. Hinge pins 8 are provided at both sides of the access opening of the main body 1 one pair by one pair.

Description will be given hereinafter with respect to several embodiments of the invention as the hinge pins 8 are disposed at the main body 1 of the refrigerator, especially at the both upper sides of the access opening thereof. The same reference numerals designate the same or similar components through the following description of the embodiments.

Embodiment 1

Figure 2:
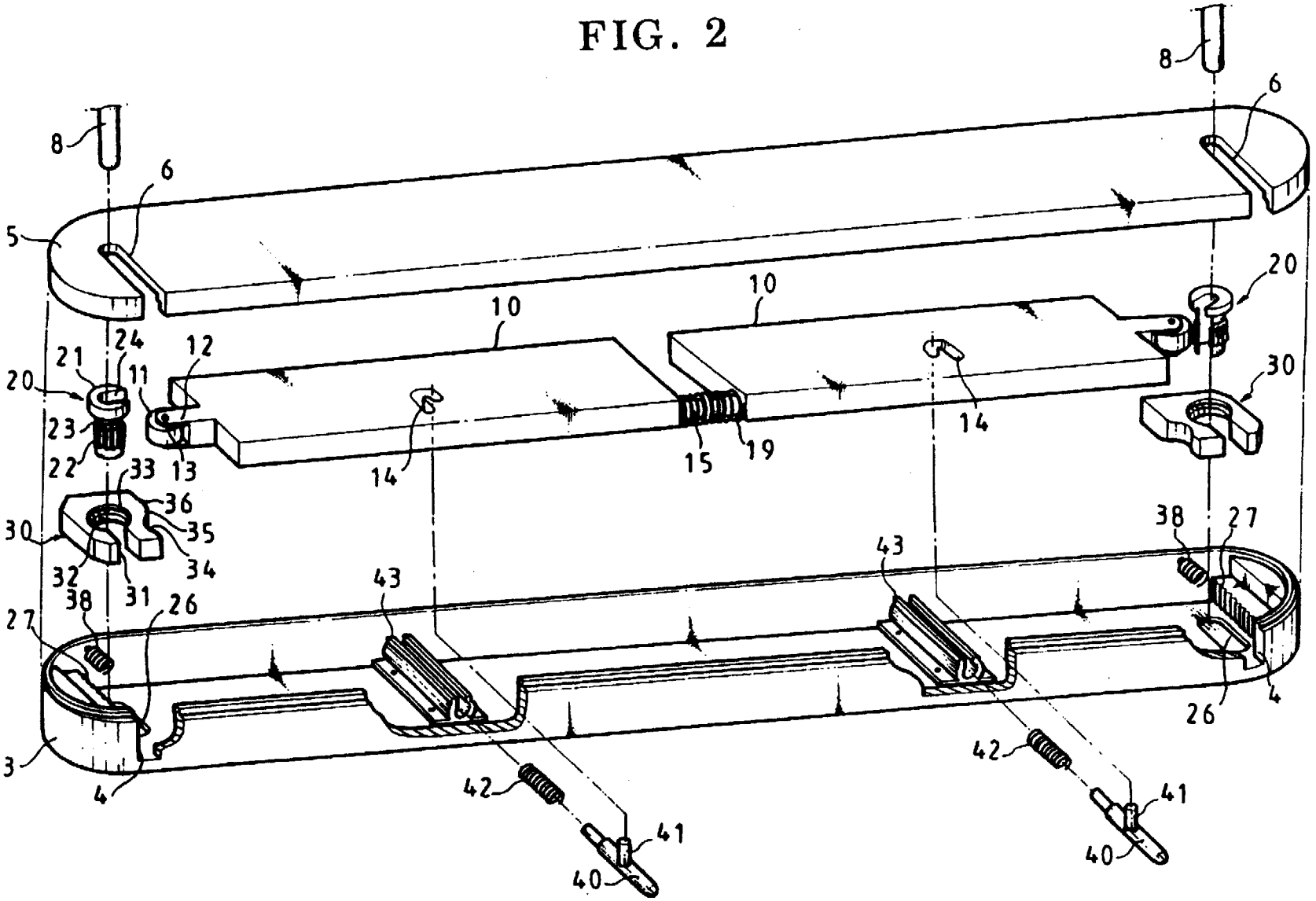
FIG. 2 is an exploded perspective view of a device according to the first embodiment of the invention.

FIG. 2 shows a exploded perspective view of a device capable of opening/closing a door at either side thereof according to the first embodiment of the present invention. As shown in the drawing, the device has a fixing member 3, which is to be disposed at the upper end of the door 2 and shall typically be disposed on the upper and lower end of the door respectively, and a cover member 5 covering the fixing member 3 to be integrated therewith and has a substantially symmetrical arrangement at both left and right sides of the figure. Corresponding to the fixing member 3, a pair of cylindrical hinge pins 8 are provided at the main body 1 to project therefrom through brackets 9.

The fixing member 3 and the cover member 5 integrated with each other forms an elongated box shape together, and is provided with a pin introduction opening 4 and a pin guide groove 6 at each of the both end regions thereof. The pin introduction openings 4 and the pin guide grooves 6 form pin travelling paths, through which each of the hinge pins 8 can come into/out the fixing member 3 with the other hinge pin 8 as pivoting center.

A pair of latch members 10 is disposed in the fixing member 3 to move in a longitudinal direction of the fixing member 3. The latch members 10 have inner ends facing each other with a predetermined gap. In the gap between the inner end 15 of the latch members 10, a compression spring 19 is provided to urge the latch member 10 outward, that is toward the both ends of the fixing member 3. Outer end of each of-the latch members 10 are mounted with a roller 11 supported rotatably by a roller support 12 and a roller pin 13.

On the bottom surfaces of the fixing mere her 3 corresponding to regions of the pin guide grooves 6, groove-like guides 26 are formed along the pin guide groove 6. Each of the guides 26 accommodates a lower end of a pin holder 20 to allow the pin holder 20 to move in the longitudinal direction of the guide 26.

The pin holders 20 have generally a cylindrical shape and are formed axially with a pin holding recess 24 for receiving radially the hinge pin 8. The pin holders 20 have a flange 21 having a relatively large diameter at a upper end region, a neck 23, a circumferential pinion-toothed portion 22 and the lower end guided by the groove-like guide 26.

A rack-toothed portion 27 is formed on the fixing member 3 along the pin guide groove 6 to engage cooperatively with the pinion-toothed portion 22 of the pin holder 20. Accordingly, when the pin holder 20 moves linearly in the guide 26, the engagement of the rack-toothed portion 27 of the fixing member 3 and the pinion-toothed portion 22 of the pin holder 20 makes the pin holder 20 to rotate on its own axis. The pin holder 20 rotates in a manner that, when the pin holder 20 is adjacent to the pin introduction opening 4, the pin holding recess 24 is opened toward the pin introduction opening 4 to receive the hinge pin 8, and when the hinge pin 8 is received in the pin holding recess 24 and introducing along the pin guide groove 6, the pin holding recess 24 is closed not to expose the hinge pin 8 against the pin introduction opening 4.

In the neck 23 between the flange 21 and the pinion-toothed portion 22 of the pin holder 20, a transverse slider 30 is provided to support rotatably the pin holder 20 and move linearly together with the pin holder 20. The transverse slider-30 has a stepped portion 33 for supporting the flange 21 of the pin holder 20, a bearing portion for contacting slidingly with the neck 23, and a pin guide slot 31 through which the hinge pin 8 arrives in the pin holding recess 24.

A side surface of the transverse slider 30 directing to the roller 11 of the latch member 10 has two stepped positions consisting of a lock position 36 of an even portion and a release position 34 of a depressed portion. The two portions 34, 36 are smoothly connected by a inclined surface 35. The spring 19 urges to contact resiliently the roller 11 of the latch member 10 and the uneven side surface of the transverse slider 30. Accordingly, the transverse movement of the transverse slider 30 in the fixing member 3 causes the roller 11 to move along the side surface of the transverse slider 30 consisting of the lock position 36, the inclined surface 35 and the release position 34 to transform into the longitudinal movement of the latch member 10. The transverse slider 30 is urged by a compression spring 38 toward pin introduction opening 4.

The latch member 10 also has a lock slot 14 consisting of two parallel transverse slot portions and a longitudinal slot portion communicated with the two parallel transverse slot portions. A lock pin 40 is disposed on the fixing member 3 capable of moving transversely to the moving direction of the latch member 10. The lock pin 40 has an external end portion projecting between the door and the main body and a stopping projection 41 moving in the lock slot 14. The lock pin 40 is urged by a spring 42 toward outside.

Figure 3:
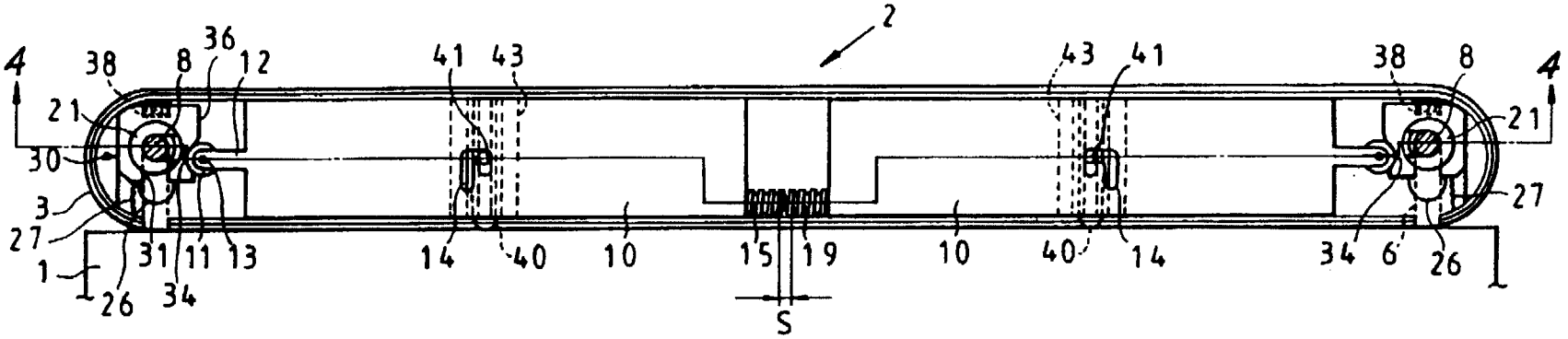
FIG. 3 is a plan view of the device shown in FIG. 2 in a closed state.
Figure 4:
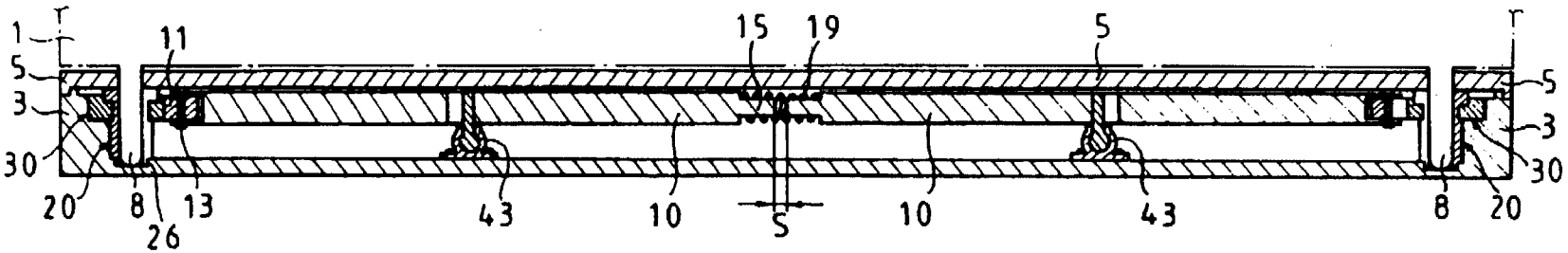
FIG. 4 is a sectional view along A—A line of FIG. 3
Figure 5:
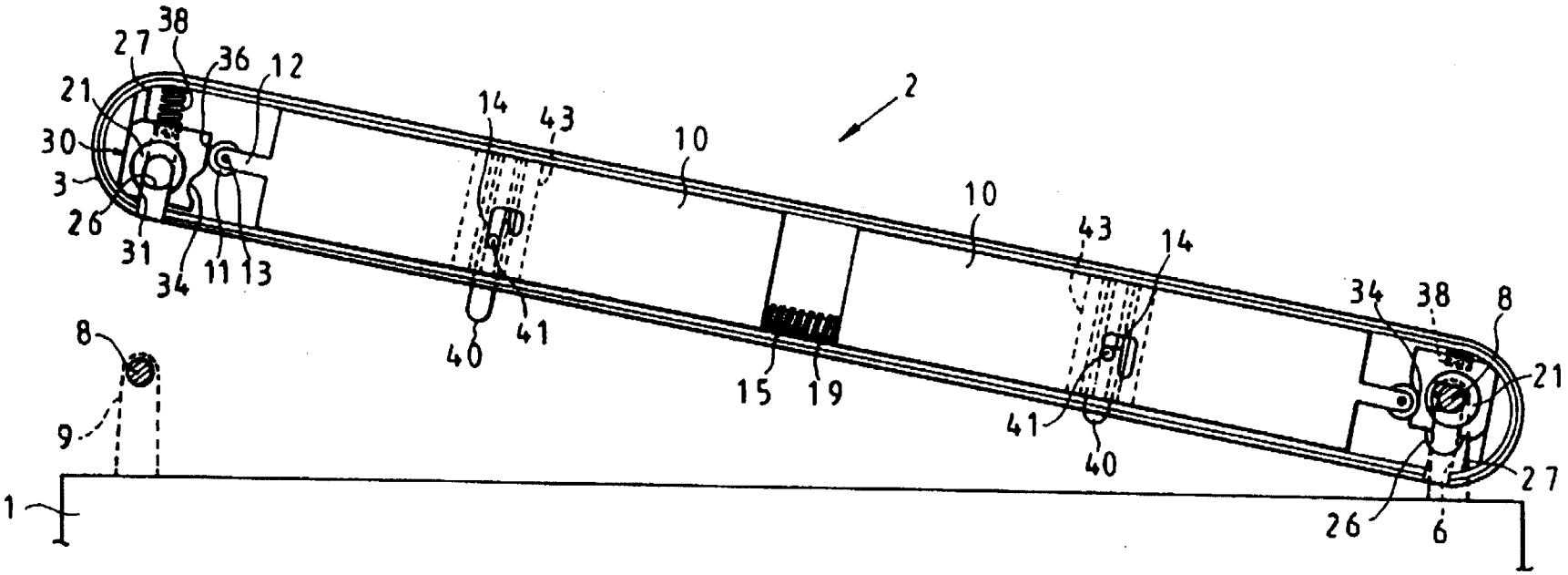
FIG. 5 is a plan view of the device shown in FIG. 2 in an open state.

FIG. 3 is a plan view of the device shown in FIG. 1 in a closed state, FIG. 4 is a sectional view along A—A line of FIG. 3 and FIG. 5 is a plan view of the device shown in FIG. 1 in an open state.

In FIG. 3 and FIG. 4 showing a closed state of the door, the both hinge pins 8 are accommodated in the pin guide grooves 6 of the cover member 5 and also in the pin holding recesses 24 of the pin holder 20. The pin holders 20 are in an about 90° rotated position to the logitudinal direction of the pin guide grooves 6.

Since the transverse sliders 30 together with the pin holders 20 are in an inner position away from the pin introduction opening 4, the rollers 11 of the latch members 10 contact with the release positions 34 of the side surfaces of the transverse sliders 30. The latch members 10 maintain the gap S between their inner ends.

When a not shown grip of the door 2 is pulled at one side, especially at the left side in the drawings, to open the door from the closed state of the door as shown in FIG. 3, the left hinge pin 8 moves along the left pin guide groove 6 of the cover member 5 outward. The left pin holder 20 also moves together with the left hinge pin 8 toward the pin introduction opening 4 and simultaneously rotates on his own axis due to the cooperation of the pinion-toothed portion 22 and rack-toothed portion 27. The left transverse slider 30 also moves along with the pin holder 20. The movement of the transverse slider 30 causes the roller 11 to move from the release position 34 over the inclined surface 35 to the lock position 36. When the pin holder 20 comes close to the pin introduction opening 4, the pin holding recess 24 opens toward the pin introduction opening 4 to allow the hinge pin 8 to escape therefrom, resulting in opening of the door.

In the meantime, due to the movement of the left roller 11 of the left latch member 10 to the lock position 36, the left latch member 10 moves toward the right latch member 10 consequently to contact their inner ends. Thereby, the right latch member 10 with the right roller 11 restricted in the release position 34 of the right transverse slider 30 is prevented from moving in longitudinal direction of the fixing member 3. The right transverse slider 30 is also restricted in the transverse movement by the right roller 11 accommodated in the release position 34 of the right transverse slider 30, consequently the right pin holder 20 receiving the right hinge pin 8 is also restricted in the state. The right hinge pin 8 serves as a pivoting axis of the opening door.

Meanwhile, when the left latch member 10 moves toward the right latch member 10, the stopping projection 41 of the lock pin 40 moves along the logitudinal slot portion and then arrives in the transverse slot portion of the lock slot 14 and the external end portion of the lock pin 40 projects out to the outside by the spring 42, as shown in FIG. 5. Thereby, the left latch member 10 of FIG. 3 is locked in the state and can not return to the position of FIG. 3, independing from the state of the left transverse slider 30 to additionally secure the lock function to the right hinge pin 8.

When the door comes close to the main body to close from the opened state of FIG. 5, the projected external end portion of the lock pin 40 contacts to the main body 1 to be retracted into the fixing member 3 against the spring 42 and then the stopping projection 41 moves back along the transverse slot portion and subsequently the logitudinal slot portion of the lock slot 14, thereby releases the latch member 10 from the locked state.

At the same time, the hinge pin 8 comes into the left pin guide groove 6 through the pin introduction opening 4 and is accommodated in the pin holding recess 24 of the pin holder 20 and then urges the pin holder 20 to move along the pin guide groove 6. The pin holder 20 moving along the pin guide groove 6 inward rotates on its own axis.

Due to the inward tranverse movement of the left pin holder 20, the left transverse slider 30 moves along with the pin holder 20, so that the roller 11 of the left latch member 10 moves from lock position 36 through the inclined surface 35 to release position 34. This causes the left latch member 10 to move away from the right latch member 10 to generate the gap S therebetween. The right latch member 10 is released in longitudinal direction and the closing operation of the door is completed.

The sliding contact of the hinge pins 8 with the pin guide grooves 6 may cause them to wear. This problem can be easily eliminated by employing a hinge pin being self-rotatable. If necessary, a thrust bearing for supporting the weight of the door may be provided at the hinge pin.

Embodiment 2

Figure 6:
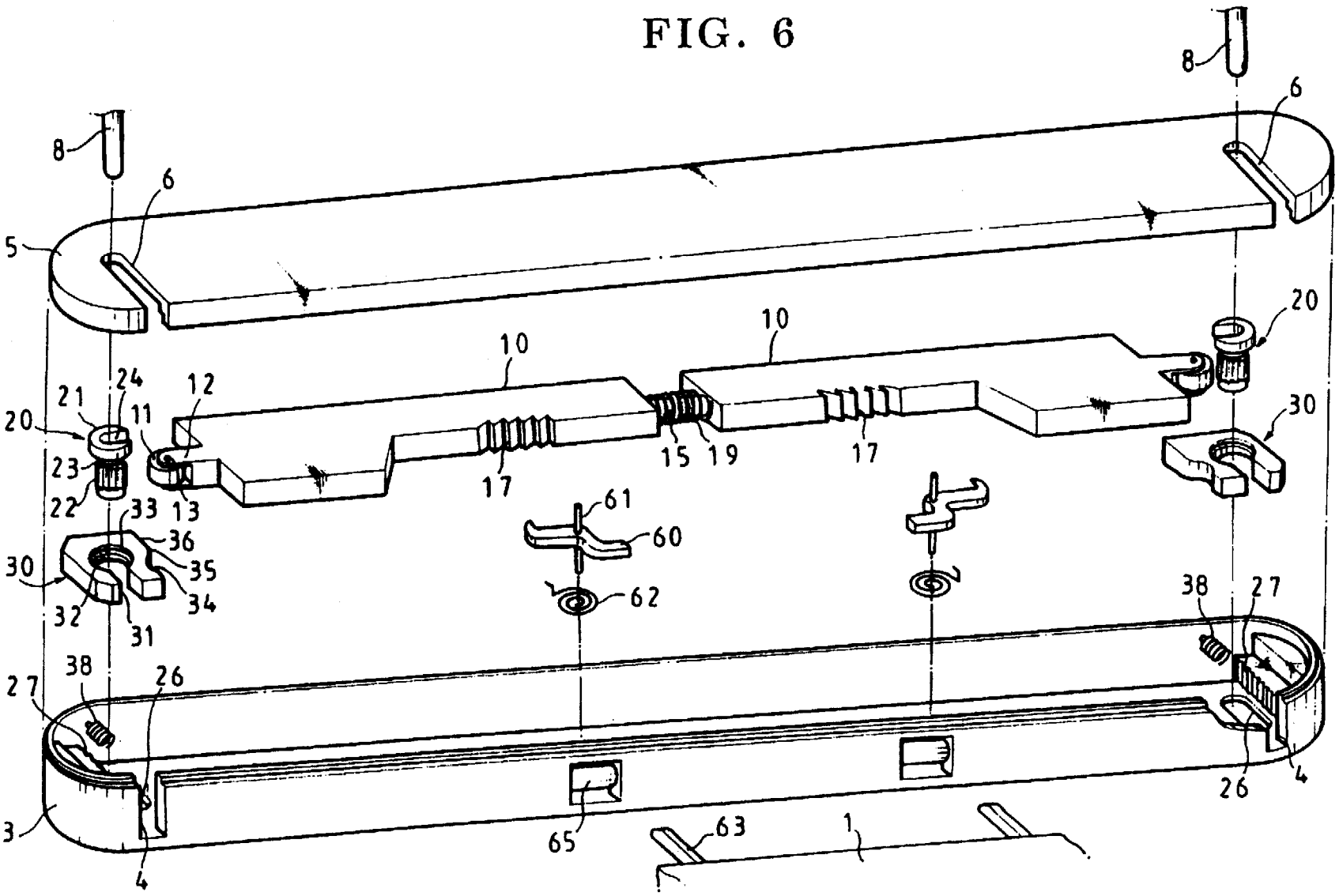
FIG. 6 is an exploded perspective view of a device according to the second embodiment.
Figure 7:
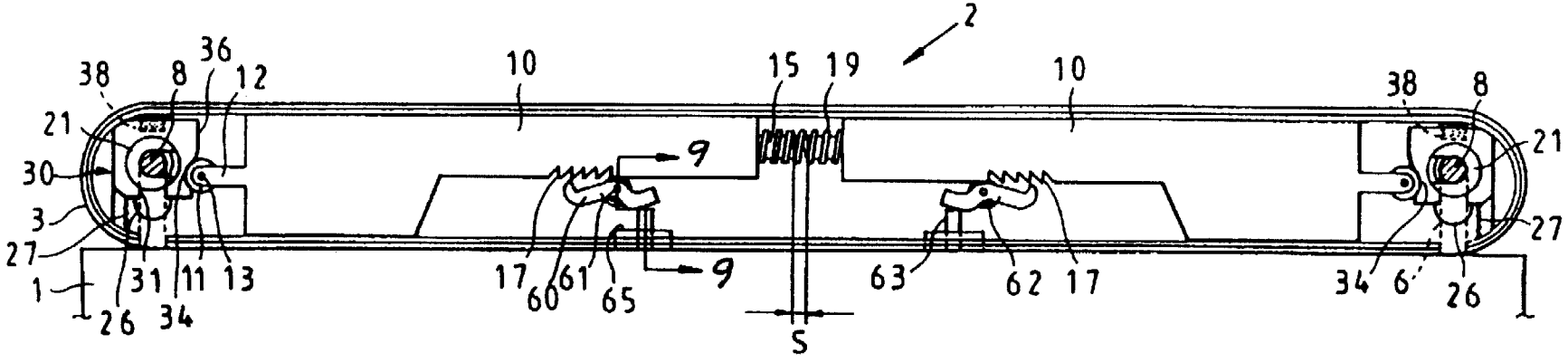
FIG. 7 and FIG. 8 are plan views of the device shown in FIG. 6 illustrating the operation in an opened state and a closed state respectively.
Figure 8:
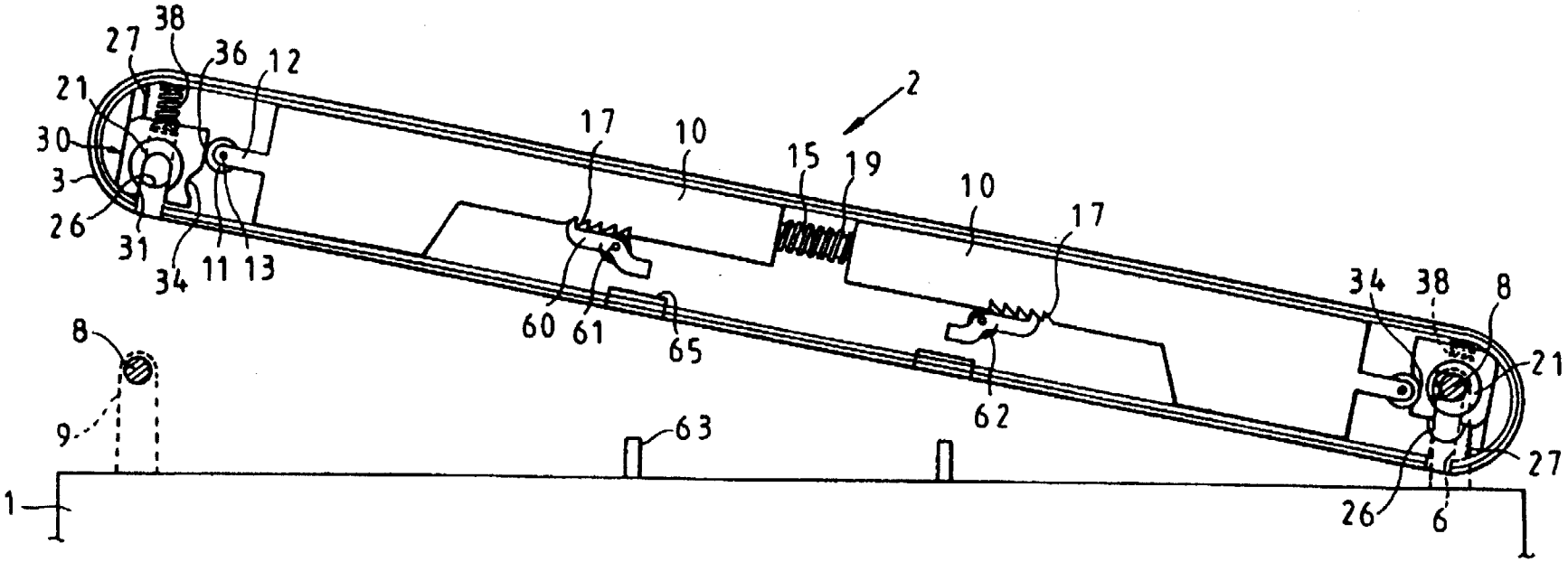

FIG. 6 to FIG. 8 show the second embodiment of this invention in an exploded perspective view and plan views in an opened and a closed state, in which another type of the lock means for the latch member 10 is employed. This lock means comprises a saw-toothed catch portion 17 formed on the side edge of the latch member 10 and a pawl member 60 fixed rotatably at a pin 61 on the fixing member 3 to engage with the catch portion 17. The pawl member 60 is resiliently urged to a direction engaging with the catch portion 17 by a spring 62. As shown in FIG. 8, the engagement of the pawl member 60 with catch portion 17 locks the latch member 10 in the opened position. On the other hand, corresponding to the free end of the pawl member 60, a projection 63 is formed on the main body 1 project toward the door.

Figure 9:
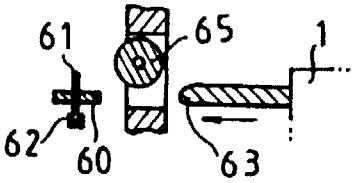
FIG. 9 is a sectional view along B—B line of FIG. 7.

When the door comes close to the main body, as shown in FIG. 9 showing a sectional view of the region of the projection 63, a free end of the projection 63 acts on the pawl member 60 to release the engagement with the catch portion 17 to allow the latch member 10 to return.

Furthermore, as shown in drawings, a roller 65 is provided on the fixing member 3. This roller 65 is to be rolled on the upper surface of the guide projection 63 when the projection 65 comes into the fixing member 3. The guide projection 65 holds up the door to prevent the from sagging with respect to the main body.

Embodiment 3

Figure 10:
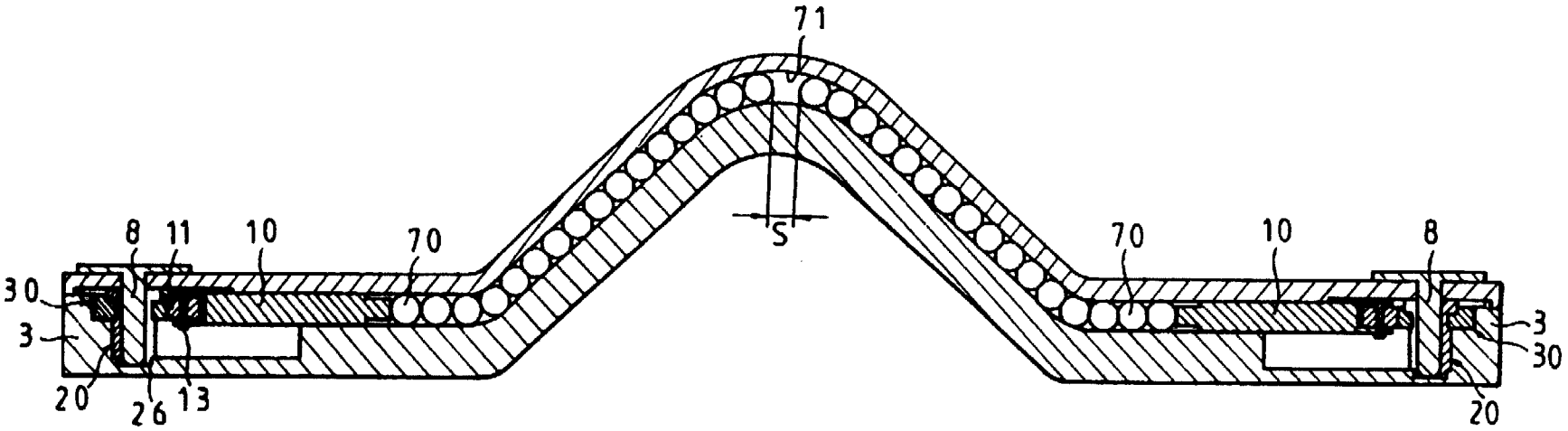
FIG. 10 is a sectional view of a device according to the third embodiment.

FIG. 10 is a cross sectional view of a device according to the third embodiment of this invention. In the previous embodiments of this invention, the latch member 10 is formed as a rigid body and directly contacts with the opposite latch member 10 to latch it. However, in this embodiment, a plurality of balls 80 are filled along the curved path 81 between the both latch members 10 with the predetermined gap. The balls 80 serve as a mediation means for transmitting the moving of one latch member 10 to the other latch member 10. Except that the balls are interposed between the latch members 10, the embodiment operates in the substantially similar manner as the previous examples. The balls 80 used in this embodiment may of course be substituted with any other flexible medium, such as rollers, wire, etc. Anyway, by using of such a flexible mediation, the device can be employed even in curved door.

Embodiment 4

Figure 11:
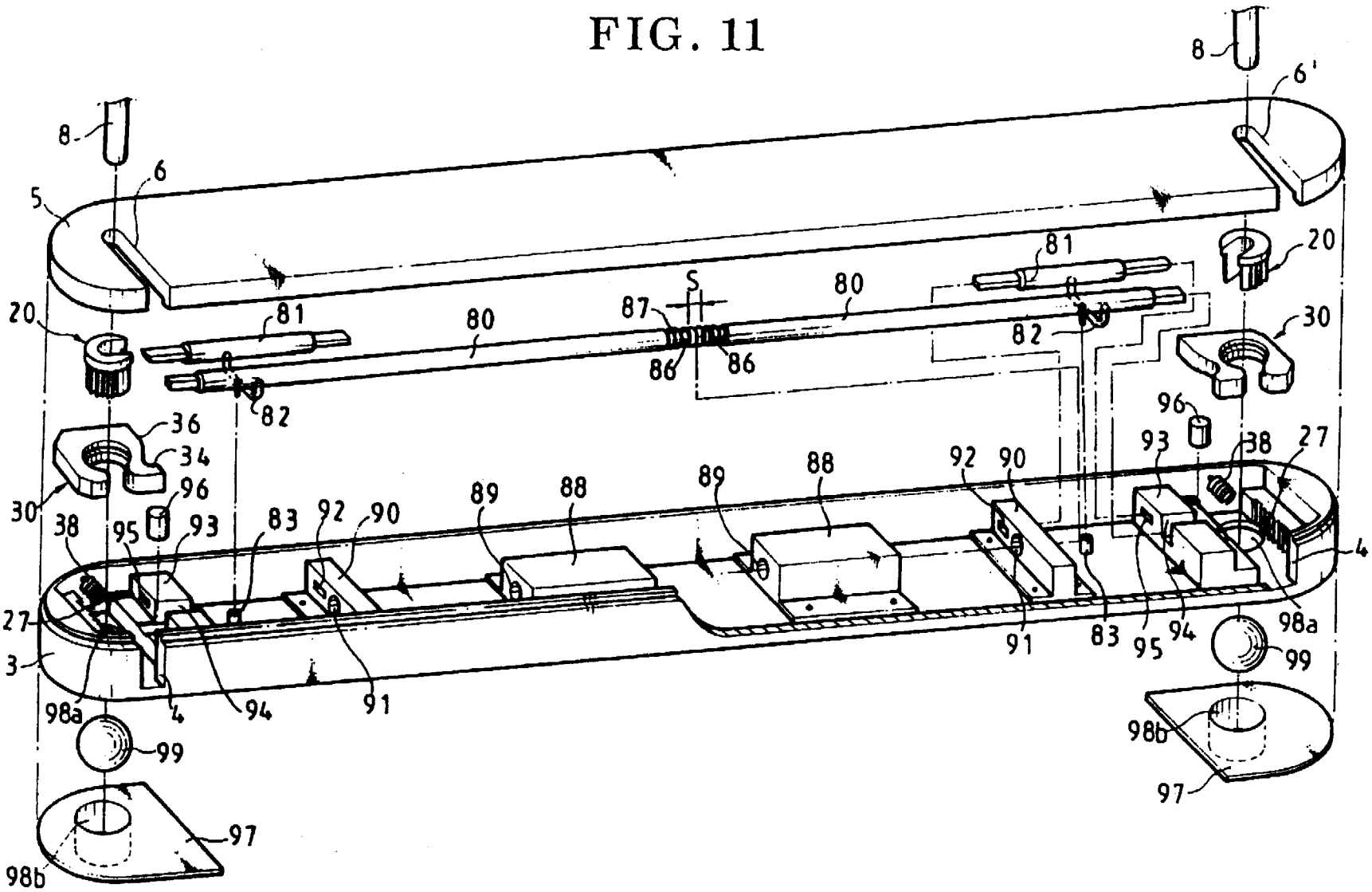
FIG. 11 is an exploded perspective view of a device according to the fourth embodiment of this invention.

FIG. 11 is an exploded perspective view of a device according to the fourth embodiment of this invention. In this embodiment, the latch members 80 have a bar-like shape and are guided by guide blocks 88, 90 having a guide hole 89, 91. The transverse sliders 30 are also guided by guide blocks 93. Each of the guide blocks 93 has a slit 94 formed in longitudinal direction of the fixing member 3. The outer end of each of the latch members 80 indirectly contacts with the side surface of the transverse slider 30 in interposition with a roller 96 through the slit 94.

Lock bars 81 are provided in parallel with the latch members 80. An inner end of the lock bar 81 is guided by the guide hole 92 of the guide block 90 and an outer end of the lock bar 81 is guided by the guide hole 95 of the guide block 93 and can project toward the transverse slider 30. The latch member 30 and the lock bar 81 are connected by an arm 82 being rotatable at a pivot pin 88 formed on the fixing member 3, so that the lock bar 81 moves contrary to the longitudinal movement of the latch member 80.

Accordingly, when the latch member 30 has moved inwardly due to opening operation of the door, that is, when the transverse slider 30 has moved toward pin introduction opening 4, the lock bar 81 is located at the rear side of the transverse slider 30 to prevent the transverse slider 30 from returning. Although an external force is applied to the transverse slider 30 when the door is opened, the transverse slider 30 can not be retracted and is maintained in a state capable of receiving the hinge pin 8 for the following closing operation.

From the state, if the hinge pin 8 is introduced into the transverse slider 30 and the pin holder 20 during the closing operation, the latch member 30 returns outwardly to move cooperatively the lock bar 81 inwardly. Consequently the transverse slider 30 is released from the lock state.

Meanwhile, FIG. 11 shows a ball 99 provided correspondingly to the distal end of the hinge pin 8 accommodated in the pin holder 20. A communication hole **98*a* is provided on the fixing member 3 to allow a direct contact between the ball 99 and the distal end of the hinge pin 8. The ball 99 is supported on the door through a bracket 97 having a ball receiving portion 93***b*.

Embodiment 5

Figure 12:
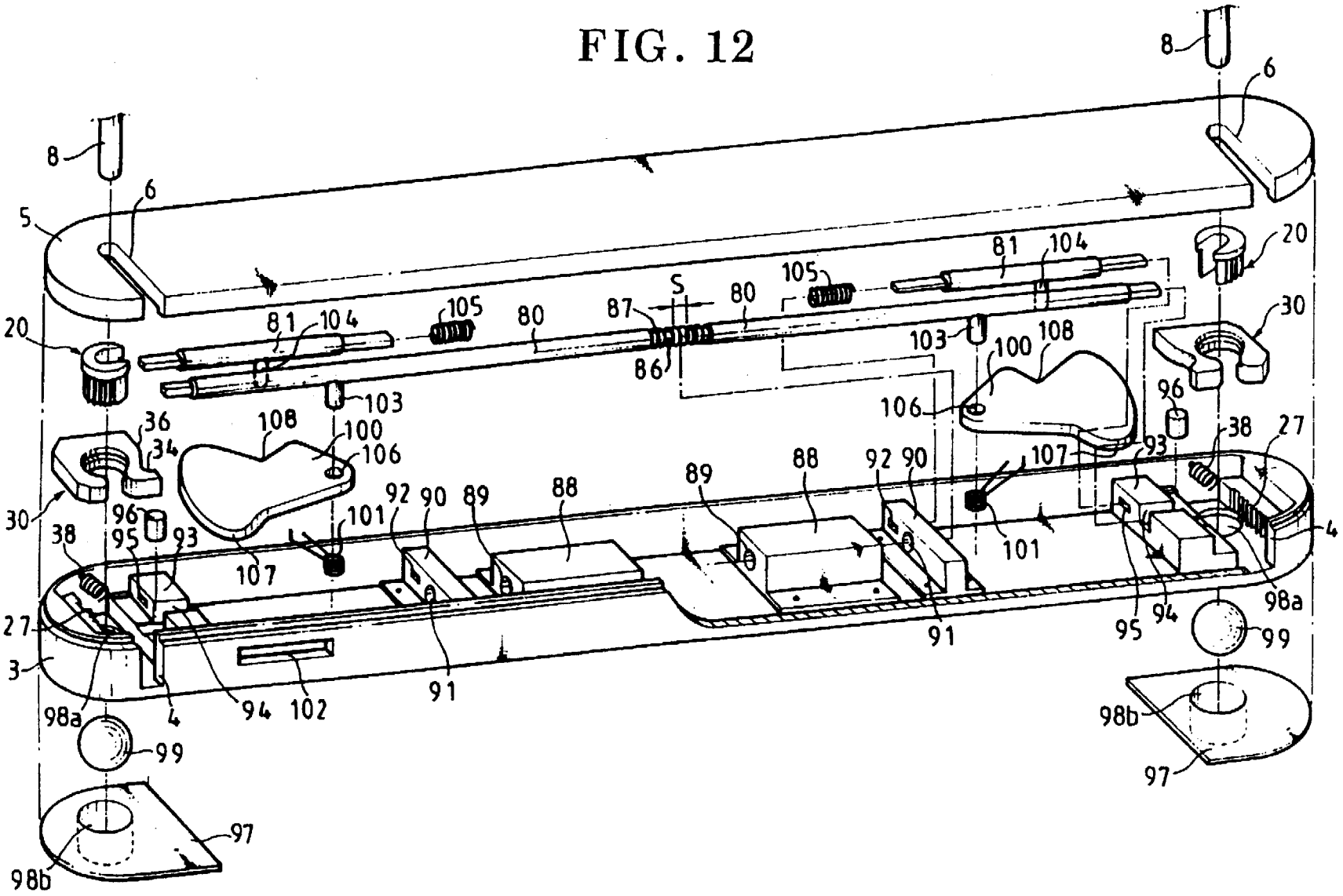
FIG. 12 is an exploded perspective view of a device according to the fifth embodiment of this invention.

FIG. 12 is an exploded perspective view of a device according to a variant of the fourth embodiment. In this embodiment, each of the latch members 80 has a pivot pin 103, an acting plate 100 is provided for receiving the pivot pin 103 to rotate at the pivot pin 103. The acting plate 100 has a projecting end 107 projecting through an opening 102 formed on the fixing member 3 toward the main body 1 and is urged to be projected by a spring 101. On the other hand, the lock bar 81 has an acting projection 104 accommodated in a recess 108 formed on an opposite side of the acting plate 100. The lock bar 81 is always urged by a spring 105 toward the transverse slider 30.

According to the arrangement, when the door is opened, the acting plate 100 rotates in the direction that the projecting end 107 projects outwardly by the spring 101, and the edge of the recess 108 urges the acting pin 104 of the lock bar 81 to move the lock bar 81 toward transverse slider 30. Then, the outer end of the lock bar 81 is located on the rear side of the transverse slider 30 having moved toward pin introduction opening 4 to prevent the transverse slider 30 from returning. Contrarily, when the door is closed, the projecting end 107 of the acting plate 100 projected outward is retracted by contacting with the main body 1, thereby the another edge of the recess 108 urges the acting pin 104 to move the lock bar 81 inward to release the rear side of the transverse slider 30.

Embodiment 6

Figure 13:
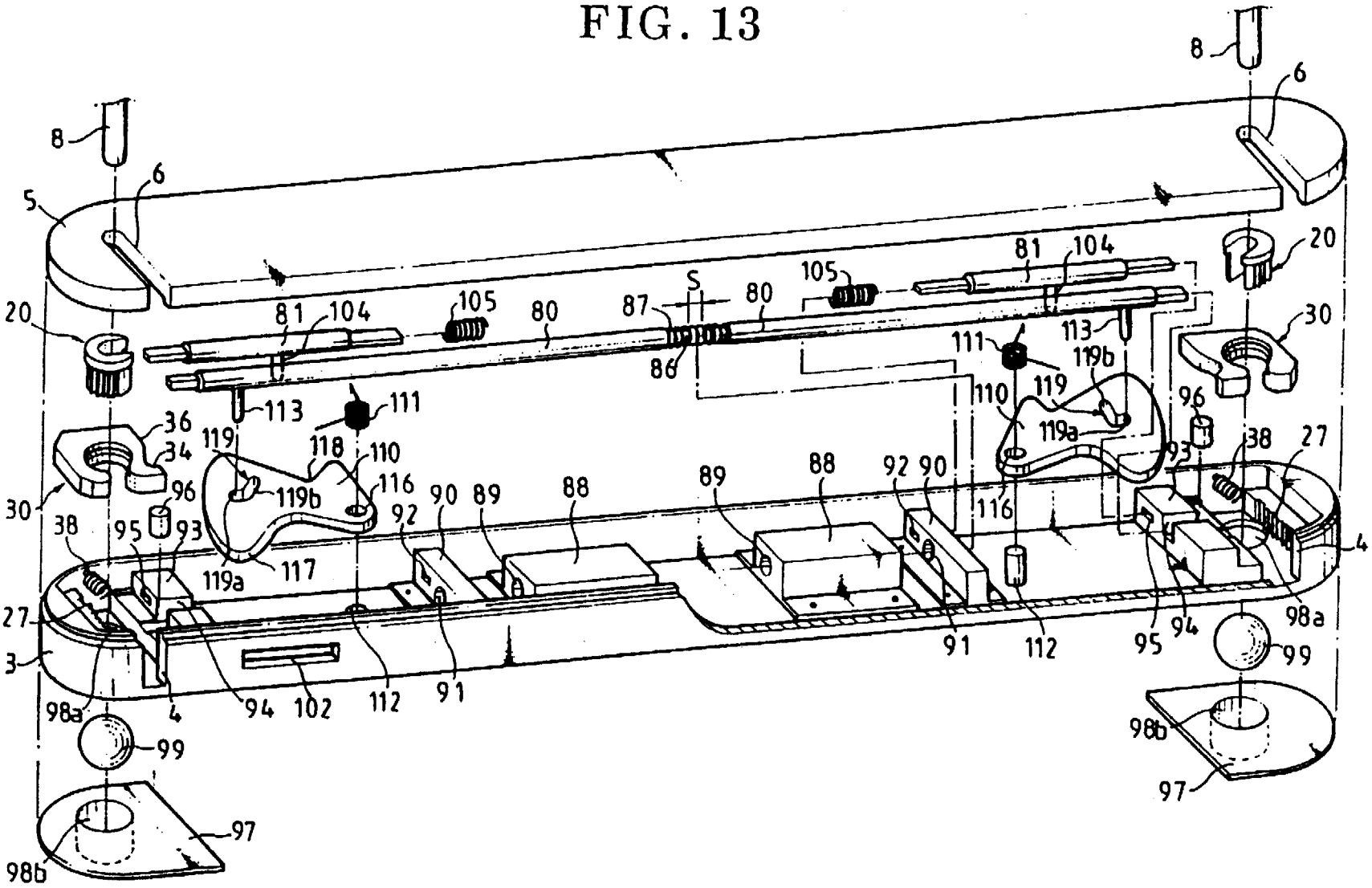
FIG. 13 is an exploded perspective view of a device according to the sixth embodiment of this invention.
Figure 14:
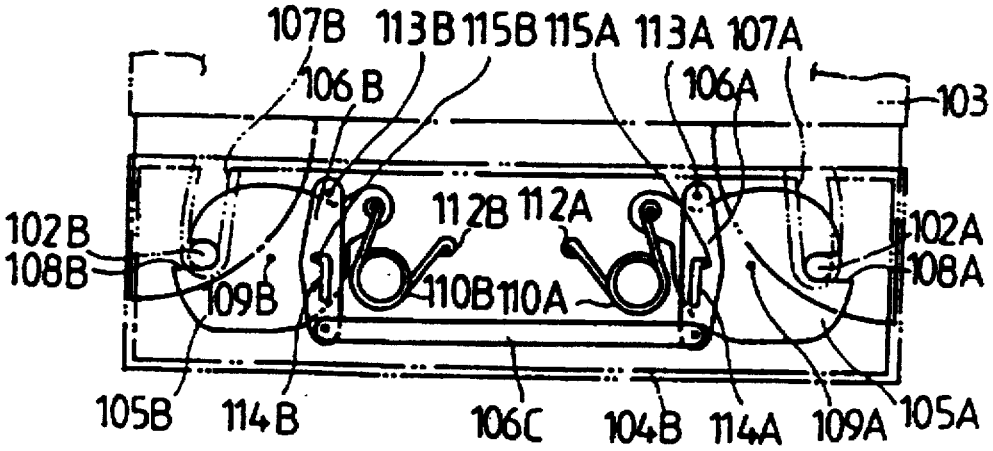
FIG. 14 PRIOR ART
FIG. 14 and FIG. 15 are plan views showing operation states of the conventional opening/closing device.
Figure 15:
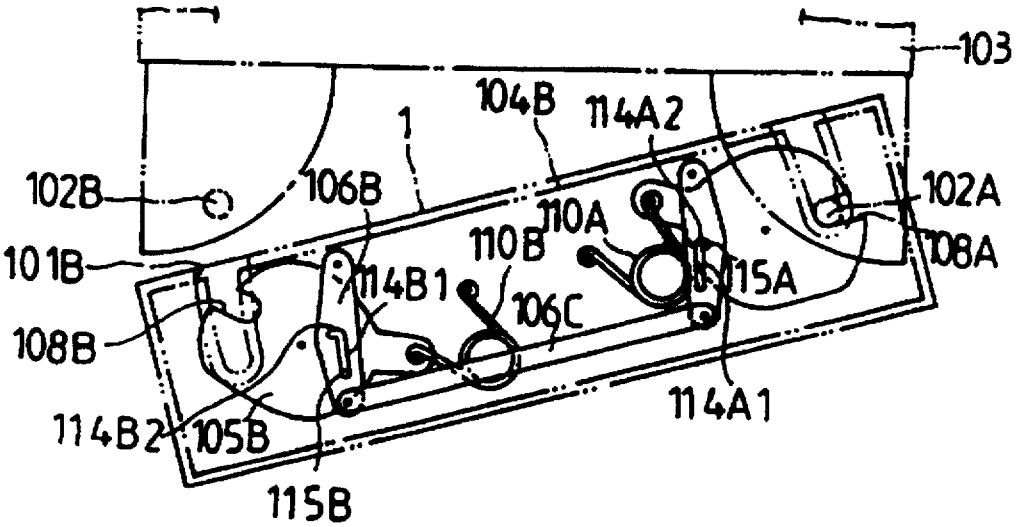
FIG. 15 PRIOR ART

FIG. 13 is an exploded perspective view of a device according to a variant of the fifth embodiment. In this embodiment, an acting plate 110 is rotatably supported at a pivot pin 112 formed on the fixing member 3. In a similar manner with the embodiment of FIG. 12, a recess 118 acts on the acting pin 104 of the lock bar 81 and a projecting end projects through the opening 102.

The acting plate 110 has a L-shaped slot 119 consisting of a longitudinal slot portion 119*a* and transverse slot portion 119*b* communicated with each other. In the slot 119, a projecting pin 115 of the latch member 80 is received.

Accordingly, the acting plate 110 acts on the lock bar 81 similarily with the acting plate 100 of the FIG. 12, simultaneously serves as a lock means for the latch member 80. That is, when the door is opened, the projecting pin 113 is located in the transverse slot portion 119*b* of the acting plate 110 to lock the latch member 80 in the longitudinal direction, and when the door is closed, the projecting pin 113 is located in the longitudinal slot portion 119*a* of the acting plate 110 to release the latch member 80.

What is claimed is:

1. A device capable of opening and closing a door to selectively close an access opening of a main body at either side thereof comprising:

at least a pair of hinge pins installed opposed to each other at opposite side end regions of one of the door and the main body with which the door is assembled;

a fixing member fixed on the other one of said door and said main body, said fixing member having pin guide grooves into and out of which each of said hinge pins comes in a pivoting direction when said door pivots at the opposite hinge pin;

a pair of pin holders mounted within said fixing member and having a pin holding recess for accommodating radially said hinge pin being introduced into said pin guide groove, each of said pin holders being capable of slidingly moving along said pin guide groove and being formed with a pinion-toothed portion on a circumferential surface;

a pair of rack-toothed portions provided on said fixing member to engage with said pinion-toothed portions of said pin holders, so that said pin holders rotate on their own axis when they are moving along said pin guide grooves;

a pair of transverse sliders mounted within said fixing member and moving together with said pin holders in the transverse direction of the fixing member; and a pair of latch members mounted within and supported by said fixing member to move in a longitudinal direction of said fixing member, said latch members having inner ends facing each other with a predetermined gap and outer ends contacting with side surface of respective corresponding transverse sliders;

wherein the side surface of said transverse slider and corresponding outer end of said latch member are correspondingly contoured such that the transverse movement of said transverse slider causes the longitudinal movement of said latch member in a manner that, when said pin holder is positioned at an entrance of said pin guide groove, said corresponding latch member is moved toward the opposite latch member to contact therewith thereby to obstruct the longitudinal movement of the opposite latch member and then the transverse movement of the opposite transverse slider, and when said pin holder is introduced into said pin guide groove, said corresponding latch member moves away from the opposite latch member to allow the longitudinal movement of the opposite latch member and the transverse movement of the opposite transverse slider.

2. The device capable of opening and closing a door at either side thereof according to claim 1, wherein at least one of the side surface of said transverse slider and the outer end of said latch member has two stepped positions and an inclined surface connecting smoothly said positions, further comprising a rolling member rotatably mounted within said fixing member between the side surface of said transverse slider and the outer end of said latch member.

3. The device capable of opening and closing a door at either side thereof according to claim 2, wherein a compression spring is provided within said fixing member for urging said transverse slider toward the entrance of said pin guide groove.

4. The device capable of opening and closing a door at either side thereof according to claim 3, wherein a compression spring is mounted in said gap between said latch members.

5. The device capable of opening and closing a door at either side thereof according to claim 3, further comprising a mediation means for transmitting movement of one latch member to the other latch member interposed between said latch members, said mediation means having flexibility to conform to a curved path.

6. The device capable of opening/closing a door at either side thereof according to claim 5, further comprising a lock means for preventing said latch member, which is at the opened side of the door and has been moved toward the opposite latch member, from returning, and for allowing said latch member to be released when said door is closing.

7. The device capable of opening and closing a door at either side thereof according to claim 6, wherein said lock means comprises a lock slot formed in each of said latch members including a longitudinal slot portion and a transverse slot portion communicated with said longitudinal slot portion, and a lock pin disposed on said fixing member to be movable transversely to the moving direction of said latch member, having an external end portion projecting between said door and said main body and a stopping projection movable within said lock slot, and being urged by a spring toward the outside thereof, thereby when one latch member moves toward the opposite latch member, said stopping projection of said lock pin moves along said longitudinal slot portion and then said transverse slot portion of said lock slot to prevent said one latch member from returning, and when said door is closed against said main body, said lock pin retracts into said fixing member against said spring and then the stopping projection moves back along said transverse slot portion and subsequently said longitudinal slot portion to release said latch member.

8. The device capable of opening and closing a door at either side thereof according to claim 6, wherein said lock means comprises a pawl mounted on said fixing member and a catch portion formed on said latch member to engage with said pawl, said pawl and said catch portion engage with each other when the door is opened to prevent the corresponding latch member from returning, and when said door comes close to said main body, said pawl and said catch portion disengage to release the corresponding latch member.

9. The device capable of opening and closing a door at either side thereof according to claim 6, further comprising a transverse slider lock means for moving cooperatively with the opening and closing movement of the door, wherein said transverse slider lock means prevents said transverse slider from returning by projecting on the rear side of the transverse slider at the opened side of the door and releasing said transverse slider when the door is closing.

* * * * *